US007108616B2

(12) United States Patent
Morrow et al.

(10) Patent No.: US 7,108,616 B2
(45) Date of Patent: Sep. 19, 2006

(54) LACROSSE STICK WITH REPLACEABLE MODULAR HANDLE SECTION

(75) Inventors: David Morrow, Metamora, MI (US); Andrew Maliszewski, Dearborn Heights, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 35 days.

(21) Appl. No.: 10/709,696

(22) Filed: May 24, 2004

(65) Prior Publication Data

US 2005/0079935 A1 Apr. 14, 2005

Related U.S. Application Data

(60) Provisional application No. 60/510,895, filed on Oct. 14, 2003.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS 2,712,950 A * 7/1955 Siebert ..... 285/7
2,850,304 A * 9/1958 Wagner ..... 285/397
2,939,163 A * 6/1960 Yonkers ..... 15/145
2,997,317 A * 8/1961 Scott ..... 285/397
3,514,135 A * 5/1970 Cooper ..... 285/397
3,904,197 A * 9/1975 Canonge ..... 482/81
4,068,346 A * 1/1978 Binder ..... 16/110.1
4,739,994 A * 4/1988 Lewis, Jr. ..... 473/513
4,940,243 A 7/1990 Tucker et al.
5,048,843 A * 9/1991 Dorfi et al. ..... 473/513
5,718,647 A 2/1998 Tiitola
5,863,269 A 1/1999 Filice
5,935,026 A * 8/1999 Dill et al. ..... 473/513
6,325,732 B1 12/2001 Ankeny
6,500,079 B1 12/2002 Tucker, Sr.
6,511,392 B1 1/2003 Chohan

* cited by examiner

*Primary Examiner*—Eugene Kim
*Assistant Examiner*—M. Chambers
(74) *Attorney, Agent, or Firm*—Artz & Artz, PC

(57) ABSTRACT

A lacrosse stick with replaceable modular handle sections includes a sectional handle, an interlocking mechanism for the sectional handle, and a head. The sectional handle includes an upper elongate section having both a top end and a locking bottom end and a lower elongate section having both a locking top end and a bottom end. The interlocking mechanism serves to interlock the locking bottom end of the upper elongate section with the locking top end of the lower elongate section. The head is mounted on the top end of the upper elongate section and includes both a closed-loop frame and a net suspended substantially within the confines of the frame. The interlocking mechanism can be unlocked so that either the upper elongate section or the lower elongate section of the sectional handle may be replaced as desired in a modular fashion with a substitutive elongate section.

27 Claims, 2 Drawing Sheets

LACROSSE STICK WITH REPLACEABLE MODULAR HANDLE SECTION

CROSS REFERENCE TO RELATED APPLICATIONS

The present application claims priority from U.S. Provisional Application Ser. No. 60/510,895, filed Oct. 14, 2003, and entitled "LACROSSE STICK WITH REPLACEABLE MODULAR HANDLE SECTION."

BACKGROUND OF INVENTION

The present invention generally relates to lacrosse sticks wielded by participants in the sport of lacrosse. The present invention more particularly relates to elongated sectional handles incorporated within such lacrosse sticks and their inherent flexibility and weight characteristics.

According to convention, a lacrosse stick basically includes both an elongated handle and a head. The elongated handle, often simply referred to as the "shaft," has both a top end and a bottom end. The head, in turn, is mounted on the top end of the elongated handle and includes both a closed-loop frame and a net suspended substantially within the confines of the frame. Together, the closed-loop frame and the net form an open pocket suited for receiving, holding, and releasing a lacrosse ball.

During play in a lacrosse game, a participant generally wields a lacrosse stick by gripping the lower elongate portion of the elongated handle with one or both hands. In doing so, a participant playing in, for example, an "attack" or "attackman" position is able to scoop up, catch, carry, pass, and make shots on goal with a ball by using the head mounted on the top end of the elongated handle. An opposing participant playing in, for example, a "defense" or "defenseman" position commonly engages and closely guards an attackman who has the ball. In doing so, the defenseman vigorously attempts to both intercept the ball and prevent the attackman from advancing the ball upfield and scoring a goal. During such engagement, sharp direct blows and indirect glancing blows are frequently inflicted at various points along the lengths of both participants" lacrosse stick handles as the defenseman, for example, stick checks the attackman.

Over time, as a lacrosse player gains experience and becomes more deft in his stick-wielding and ball-handling skills, the player typically develops strong preferences for lacrosse sticks with handles having a certain inherent stiffness/flexibility characteristic and a certain weight characteristic. Such preferences are particularly "felt" and desired in the lower elongate portion of the handle where the player grips and thereby wields the stick. In general, both the stiffness/flexibility characteristic and the weight characteristic of a particular handle are largely determined by factors including material composition, physical dimensions, and fabrication processing techniques. Given that such factors are predetermined and closely monitored by stick fabricators and manufacturers, players are informedly cognizant of the various stiffness/flexibility characteristics and weight characteristics of individual lines of lacrosse sticks that are sold at the retail level. In this way, an individual player is able to select a lacrosse stick having a handle with a stiffness/flexibility characteristic and a weight characteristic in accordance with his personal preferences.

Sometimes, however, the stiffness/flexibility characteristic of a lacrosse stick's handle is unexpectedly altered, either temporarily or permanently, by other supervening factors.

For example, during play in outdoor cold weather conditions, the elongated handle is prone to becoming noticeably more stiff and less flexible than in warm weather conditions. Consequently, an experienced player may feel that his level of play is being adversely affected by the increased stiffness and reduced flexibility of the stick's handle. Under such conditions, though temporary, the player may desire a stick handle with increased flexibility, particularly in the lower elongate gripping portion, to compensate for the cold weather.

In another example, one or more severe blows inflicted upon a stick's elongated handle during engagement between players in a game may permanently damage and compromise the structural integrity of the handle at a certain point along its length. When such occurs, the lacrosse stick is essentially rendered unfit for further play, and the entire stick is typically thrown away. In some instances, however, only the entire elongated handle is thrown away if the head is deemed salvageable and can easily be removed from the handle. In either of such cases, a player generally must newly purchase an entire handle to replace the damaged one even though the original handle was only damaged at one point along its entire length.

In light of the above, there is a present need in the art for a lacrosse stick that enables a player to replace a portion of the elongated handle, either temporarily or permanently, without having to replace the entire elongated handle or lacrosse stick altogether.

SUMMARY OF INVENTION

The present invention provides a lacrosse stick with a replaceable modular handle section. The lacrosse stick includes a sectional handle, an interlocking mechanism for the sectional handle, and a head. The sectional handle includes an upper elongate section having both a top end and a locking bottom end and a lower elongate section having both a locking top end and a bottom end. The interlocking mechanism, in turn, serves to interlock the locking bottom end of the upper elongate section with the locking top end of the lower elongate section such that the upper elongate section is substantially axially aligned with the lower elongate section. The head is mounted on the top end of the upper elongate section of the sectional handle. The head itself primarily includes both a closed-loop frame and a net suspended substantially within the confines of the frame.

In such a configuration, the interlocking mechanism can be unlocked so that either the upper elongate section or the lower elongate section of the sectional handle may be replaced as desired in a modular fashion with a substitutive elongate section. In this way, various upper or lower elongate sections, perhaps with different flexibilities or weight characteristics, can be singly incorporated and selectively interchanged within the handle by a lacrosse player on either a temporary or permanent basis.

Advantages, design considerations, and applications of the present invention will become apparent to those skilled in the art when the detailed description of the best mode contemplated for practicing the invention, as set forth herein below, is read in conjunction with the accompanying drawings.

BRIEF DESCRIPTION OF DRAWINGS

The present invention will be described, by way of example, with reference to the following drawings.

DETAILED DESCRIPTION

Figure 1:
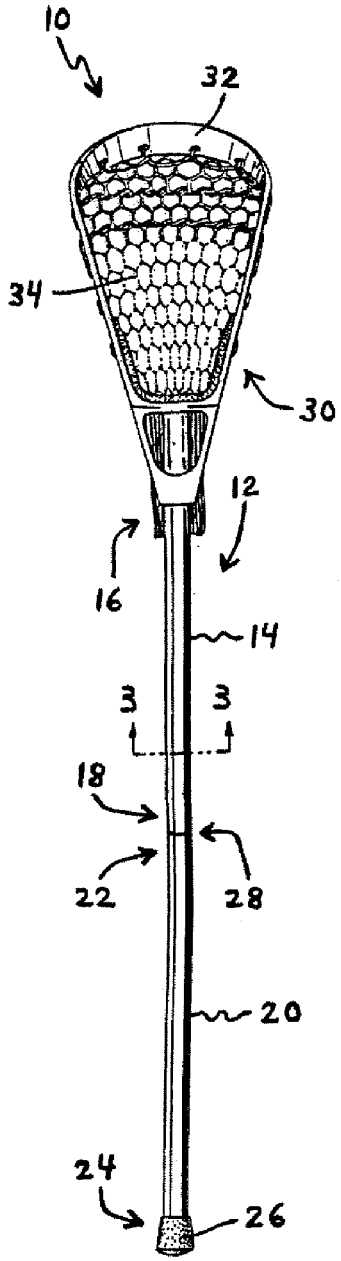
FIG. 1 illustrates a frontal view of a lacrosse stick including both a head and a sectional handle.
Figure 2:
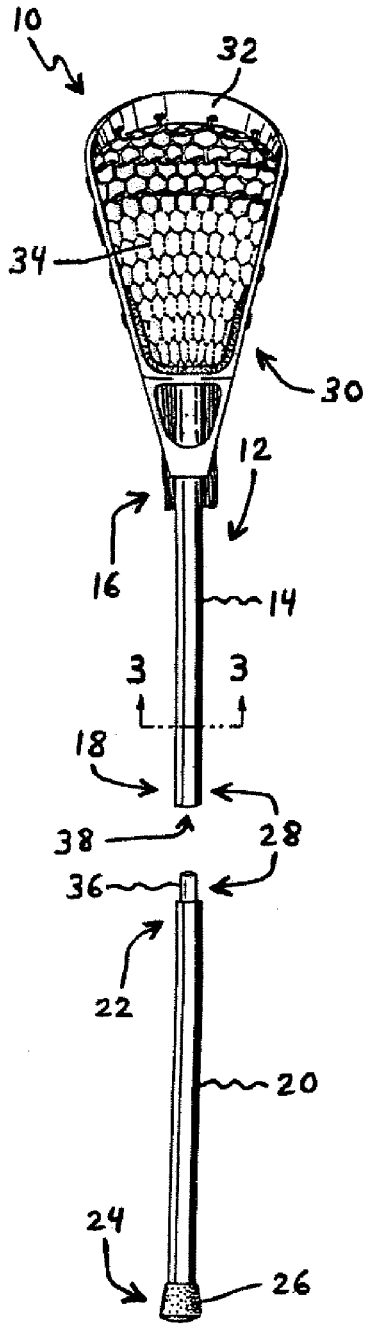
FIG. 2 illustrates a frontal view of the lacrosse stick illustrated in FIG. 1, wherein the upper elongate section and the lower elongate section of the sectional handle have been unlocked and separated from each other.

In FIGS. 1 and 2, frontal views of a lacrosse stick 10 according to the present invention are illustrated therein. As illustrated, the lacrosse stick 10 includes a sectional handle 12, an interlocking mechanism 28 for the sectional handle 12, and a head 30.

In one embodiment, the sectional handle 12 includes both an upper elongate section 14 and a lower elongate section 20 which are separable from each other. The upper elongate section 14 has both a top end 16 and a locking bottom end 18. The lower elongate section 20, in contrast, has both a locking top end 22 and a bottom end 24. An end cap 26 made of relatively soft material, such as rubber or plastic, is tightly fitted over the bottom end 24 of the lower elongate section 20. Although the sectional handle 12 in FIGS. 1 and 2 is illustrated as being bisectioned such that the upper elongate section 14 and the lower elongate section 20 are substantially equal in length, it is to be understood that the handle 12 may be alternatively designed and sectioned such that the upper elongate section 14 and the lower elongate section 20 have different lengths. Furthermore, it is also to be understood that the handle may be alternatively designed and sectioned such that it can be broken down and separated into three or more elongate sections.

Figure 3:
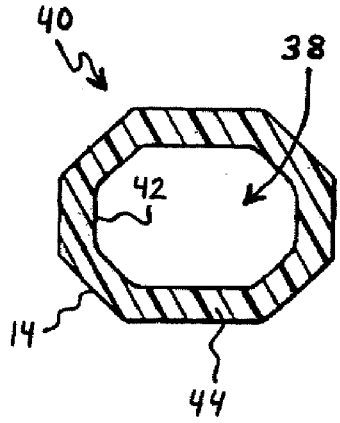
FIG. 3 illustrates a cross-sectional view of the upper elongate section of the sectional handle illustrated in FIGS. 1 and 2.

To ensure that the lacrosse stick 10 is relatively light, the sectional handle 12 is preferably made of substantially hollow tubing. As illustrated in FIG. 3, the hollow tubing of the sectional handle 12 has a cross-section 40 that substantially resembles the shape of an octagon to thereby facilitate favorable hand gripping with minimal slippage. It is to be understood, however, that the sectional handle 12 may alternatively be designed such that it has a cross-section that instead resembles, for example, a circle, an ellipse, some other polygon, or any combination thereof. It will also be understood that the configuration of the handle may take on a variety of other configurations.

Although other constituent materials may indeed be utilized, in one embodiment, the upper elongate section 14 of the sectional handle 12 is made of a hardy and yet light metallic material including, for example, aluminum, an aluminum alloy, or titanium. The lower elongate section 20, on the other hand, is made to include one or more constituent materials such as, for example, aluminum, chromium, copper, fiberglass, graphite, iron, manganese, magnesium, plastic, silicon, titanium, zinc, or suitable combinations thereof. In another embodiment, however, the lower elongate section 20 of the sectional handle 12 is made of a flexible material to thereby provide a portion of the sectional handle 12 with varying flexibility characteristics. In yet another embodiment, the lower elongate section 20 is made of aluminum, which is substantially covered with braided or woven graphite fibers. Such a material composition for the lower elongate section 20 is desirable for its inherent durability and its favorable stiffness/flexibility characteristics.

The head 30, next of all, is mounted on the top end 16 of the upper elongate section 14 of the sectional handle 12. The head 30 itself primarily includes both a closed-loop frame 32 and a net 34. The head 30 is preferably made of any conventionally known moldable material such as, for example, plastic. The net 34, in turn, is attached to the closed-loop frame 32 such that the net 34 is suspended substantially within the confines of the frame 32. Together, the closed-loop frame 32 and the net 34 form an open pocket suited for receiving, holding, and releasing a lacrosse ball.

The interlocking mechanism 28 is largely incorporated or embodied within both the locking bottom end 18 of the upper elongate section 14 and the locking top end 22 of the lower elongate section 20. In general, the interlocking mechanism 28 serves to interlock the locking bottom end 18 of the upper elongate section 14 with the locking top end 22 of the lower elongate section 20 such that the upper elongate section 14 is substantially axially aligned with the lower elongate section 20 as in FIG. 1. As illustrated in FIG. 2, the interlocking mechanism 28 can also be unlocked so that either the upper elongate section 14 or the lower elongate section 20 of the elongated handle 12 may be separated and replaced as desired in a modular fashion with a substitutive elongate section. The interlocking mechanism 28 also preferably includes a release mechanism that allows the upper elongate section 14 to be separated from the lower elongate section 20. In one example, various lower elongate sections with different flexibilities or weight characteristics can be singly incorporated and selectively interchanged within the handle 12 by a lacrosse player on either a temporary or permanent basis. It will be appreciated that any suitable mechanism that attaches the portions of the handle together may be utilized.

Figure 4:
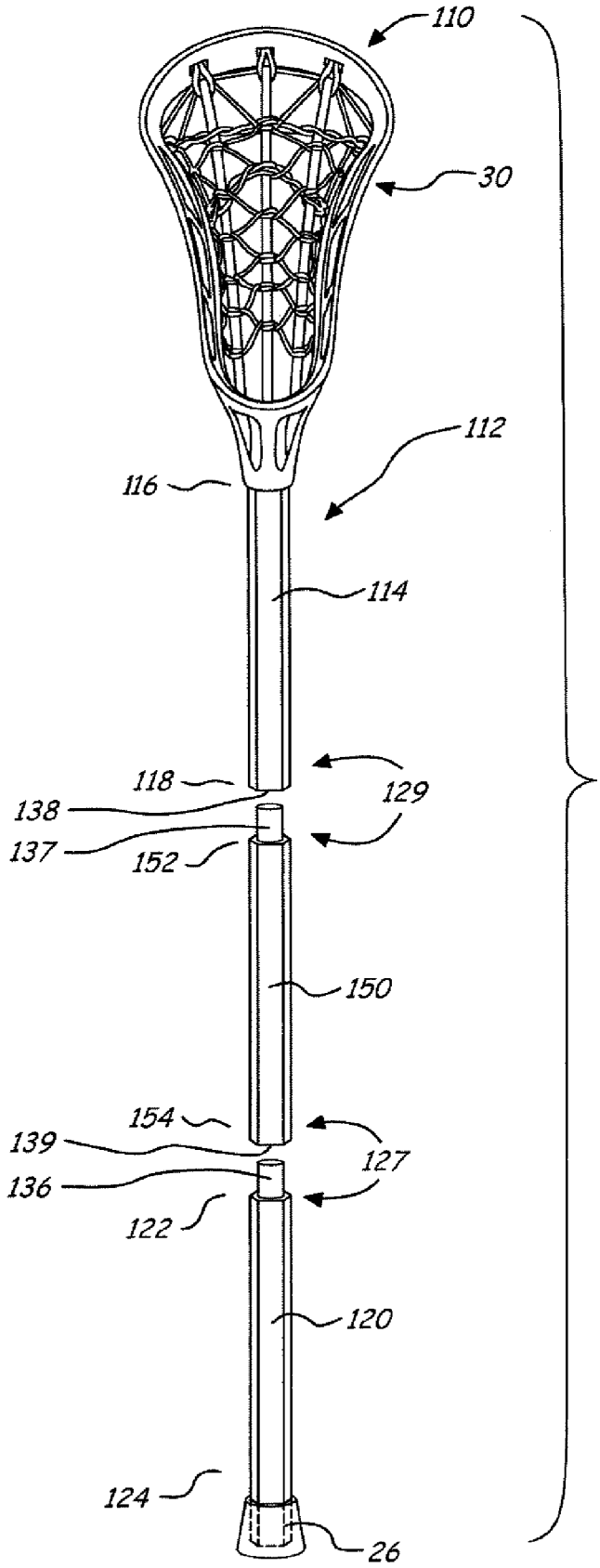
FIG. 4 illustrates a frontal view of an alternative embodiment of a lacrosse stick including a head and a sectional handle.

Referring to FIG. 4, which illustrates a lacrosse stick wherein the sectional handle 110 is alternatively designed and sectioned such that it can be broken down and separated into three or more elongate sections. It is to be understood that in this embodiment, two or more interlocking mechanisms 28 may necessarily be included therein. In this way, various elongate sections with different flexibility characteristics can be collectively incorporated in various combinations and selectively interchanged within the elongated handle as desired to thereby provide a handle with varying degrees of flexibility at various different locations along its length.

More specifically, the lacrosse stick 110 illustrated in FIG. 4 includes a head 30, a sectional handle 112 and two interlocking mechanisms 127, 129 for the sectional handle. The sectional handle 112 includes an upper elongate section 114, a lower elongate section 120 and an intermediate elongate section 150. The upper elongate section 114 has both a top end 116 and a locking bottom end 118. The lower elongate section 120 has both a locking top end 122 and a bottom end 124. The intermediate elongate section 150 has a locking top end 152 and a locking bottom end 154 and is positioned between the upper and lower elongate sections 114, 120. The head 30 is mounted on the top end 116 of the upper elongate section 114 of the sectional handle 112. A cap 26 made of relatively soft material, such as rubber or plastic, is tightly fitted over the bottom end 124 of the lower elongate section 150. Although the sectional handle 112 in FIG. 4 is illustrated as being sectioned such that the upper elongate section 114, the intermediate elongate section 150, and the lower elongate section 120 are substantially equal in length, it is to be understood that the handle 112 may be alternatively designed and sectioned such that the sections take on a variety of different lengths to provide desired performance characteristics.

In this embodiment, the sectional handle 112 includes two interlocking mechanisms 127, 129. The first interlocking mechanism 129 particularly includes an axially aligned protrusion 137 located on the locking top end 152 of the intermediate elongate section 150. The protrusion 137 is particularly shaped and suited for being matingly received and firmly locked within a hollow 138 formed in the locking bottom end 118 of the upper elongate section 114 so that the upper elongate section 114 can be interlocked with the intermediate elongate section 150. In general, the first interlocking mechanism 129 serves to interlock the locking bottom end 118 of the upper elongate section 114 with the locking top end 152 of the intermediate elongate section 150 such that the upper elongate section 114 is substantially axially aligned with the intermediate elongate section 150. Similarly, the second interlocking mechanism 127 particularly includes an axially aligned protrusion 136 located on the locking top end 122 of the lower elongate section 120. The protrusion 136 is particularly shaped and suited for being matingly received and firmly locked within a hollow 139 formed in the locking bottom end 154 of the intermediate elongate section 150 so that the intermediate elongate section 150 can be interlocked with the lower elongate section 120. The second interlocking mechanism 127 serves to interlock the locking bottom end 154 of the intermediate elongate section 150 with the locking top end 122 of the lower elongate section 120 such that the intermediate elongate section 150 is substantially axially aligned with the lower elongate section 120. Interlocking mechanisms 127, 129 can also be unlocked so that either the upper elongate section 114, the intermediate elongate section 150 or the lower elongate section 120 of the sectional handle 112 may be separated and replaced as desired in a modular fashion with a substitutive elongate section.

As further illustrated in FIG. 2, the interlocking mechanism 28 itself particularly includes an axially aligned protrusion 36 located on the locking top end 22 of the lower elongate section 20. The protrusion 36 is particularly shaped and suited for being matingly received and firmly locked within a hollow 38 formed in the locking bottom end 18 of the upper elongate section 14 so that the upper elongate section 14 can be interlocked with the lower elongate section 20 as in FIG. 1. To ensure that the protrusion 36 is able to be firmly locked as such, the protrusion 36 preferably includes two or more extendable/retractable tabs or pins (not shown) that are circumferentially positioned on the protrusion 36 such that they radially protrude from the mating outer surface of the protrusion 36 when they are in extended positions. In cooperation therewith, the locking bottom end 18 of the upper elongate section 14 preferably includes a matching number of recesses or holes (not shown) defined within its mating inner surface 42 that are specifically positioned and aligned for closely receiving the pins as they simultaneously "pop" into their extended positions once the protrusion 36 has been fully inserted within the hollow 38 of the locking bottom end 18 of the upper elongate section 14. Such holes defined within the mating inner surface 42 of the upper elongate section 14 preferably penetrate completely through the wall 44 of the upper elongate section 14 to thereby provide outside access to the extended pins. In this way, an unlocking device or "key" with matching pins can be closely wrapped about the upper elongate section 14 over the holes defined therethrough to thereby simultaneously press the extended pins back into retracted positions so that the protrusion 36 becomes unlocked. Once unlocked in this manner, the protrusion 36 can then be pulled from the hollow 38 of the upper elongate section 14 to thereby free and separate the upper elongate section 14 and the lower elongate section 20 from each other.

With final regard to the interlocking mechanisms 28, 127, 129 it is to be understood that many variations thereof may alternatively be implemented pursuant to the present invention. For example, the protrusions 36, 136, 137 may alternatively be located on the locking bottom ends 18, 118, 154 of the upper elongate sections 14, 114 or the intermediate elongate section 150 such that the protrusions 36, 136, 137 are instead received within the hollow of the lower elongate section 20, 120 or the intermediate elongate section 150. As another example, both the mating outer surface of the protrusion 36 and the mating inner surface 42 of the bottom end 18 of the upper elongate section 14 may be complementarily threaded so that the upper elongate section 14 and the lower elongate section 20 can thereby be firmly screwed together. Similarly, for the alternative embodiment shown in FIG. 4, the mating outer surface of protrusions 136, 137 and the mating inner surface of the bottom end of the intermediate elongate section 150 and the upper elongate section 114 may be complementarily threaded so that the upper elongate section 114 and the intermediate elongate section 150 can thereby be firmly screwed together and the intermediate elongate section 150 and the lower elongate section 120 can thereby be firmly screwed together. As further examples, the elongate sections 14, 20 may be welded or press fit together. In general, any conventionally known means for releasably fastening the ends of two tubular sections together in a collinear fashion may be implemented to serve as an interlocking mechanism for purposes of the present invention.

In summary, a lacrosse stick with a sectional handle having a replaceable modular upper, intermediate and lower elongate sections as described hereinabove generally has the following advantages. First, various substitutive upper, intermediate, and lower elongate sections with different flexibilities or weight characteristics can be singly incorporated and selectively interchanged, one at a time, within the handle as desired by a lacrosse player on either a temporary or permanent basis. Second, if one of either the upper elongate section, the intermediate elongate section or the lower elongate section of the sectional handle becomes permanently damaged during play, then only the damaged section need be replaced instead of having to replace the entire handle or stick. Third, if a player desires to change the weight or flex characteristics of the lacrosse stick, they can easily do so by changing one section of the handle and replacing it with a section having the desired characteristics. Furthermore, it is believed that many other advantages will become apparent as well to those skilled in the art of designing, fabricating, manufacturing, and utilizing lacrosse sticks.

While the present invention has been described in what is presently considered to be its most practical and preferred embodiment or implementation, it is to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A sectional handle for a lacrosse stick, said sectional handle comprising:

an upper elongate section having a top end and a locking bottom end;

a lower elongate section having a locking top end and a bottom end; and a mechanism for interlocking said locking bottom end of said upper elongate section with said locking top end of said lower elongate section such that said upper elongate section is substantially axially aligned with said lower elongate section;

wherein said top end of said first upper elongate section is suited for having mounted thereon a head including both a closed-loop frame and a net suspended substantially within the confines of said frame;

wherein at least one of said upper or lower elongate sections is modular and said interlocking mechanism is releasable to allow at least one of said upper elongate section or said lower elongate section to be replaced as desired; and wherein said upper elongate section and said lower elongate section are constructed of different materials such that they provide the handle sections with different performance characteristics; and wherein said elongate sections are interchangeable.

2. A sectional handle according to claim 1, wherein the length of said upper elongate section is substantially equal to the length of said lower section.

3. A sectional handle according to claim 1, wherein said upper elongate section and said lower elongate section each comprise substantially hollow tubing having a cross-section substantially resembling a shape selected from the group consisting of a circle, an eclipse, a polygon, and an octagon.

4. A sectional handle according to claim 3, wherein said lower elongate section comprises at least one constituent material selected from the group consisting of aluminum, chromium, copper, fiberglass graphite, iron, manganese, magnesium plastic, silicon, titanium, and zinc.

5. A sectional handle according to claim 3, wherein said lower elongate section is formed of a composite containing both aluminum and graphite.

6. A sectional handle according to claim 3, wherein said lower elongate section is formed of aluminum substantially covered with woven graphite fibers.

7. A sectional handle according to claim 3, wherein said interlocking mechanism includes an axially aligned protrusion located on one of either said locking bottom end of said upper elongate section or said locking top end of said lower elongate section, and wherein said protrusion is suited for being ma tingly received and locked within the hollow of the other one of either said locking bottom end of said upper elongate section or said locking top end of said lower elongate section.

8. A sectional handle according to claim 1, wherein said upper elongate section comprises aluminum.

9. A sectional handle according to claim 1, wherein said upper elongate section comprises titanium.

10. A sectional handle, according to claim 1, said sectional handle further comprising at least one substitutive upper elongate section;

wherein each said substitutive upper elongate section similarly has a top end and a locking bottom end; and wherein each said substitutive upper elongate section has a unique flexibility characteristic and is selectively interchangeable in a modular fashion, with said upper elongate section interlocked within said sectional handle.

11. A sectional handle according to claim 1, said sectional handle further comprising at least one substitutive lower elongate section;

wherein each said substitutive lower elongate section similarly has a locking top end and a bottom end; and wherein each said substitutive lower elongate section has a unique flexibility characteristic and is selectively interchangeable, in a modular fashion, with said lower elongate section interlocked within said sectional handle.

12. A sectional handle according to claim 1, further comprising an intermediate elongate section having a locking top end and a locking bottom end, wherein said mechanism interlocks said locking bottom end of said upper elongate section with said locking top end of said intermediate elongate section such that said upper elongate section is substantially axially aligned with said intermediate elongate section; and a second mechanism for interlocking said locking bottom end of said intermediate elongate section with said locking top end of said lower elongate section such that said intermediate elongate section is substantially axially aligned with said lower elongate section.

13. A sectional handle according to claim 12, said sectional handle further comprising at least one substitutive intermediate elongate section;

wherein each said substitutive intermediate elongate section similarly has a locking top end and a locking bottom end; and wherein each said substitutive intermediate elongate section has a unique flexibility characteristic and is selectively interchangeable, in a modular fashion, with said intermediate elongate section interlocked within said sectional handle.

14. A lacrosse stick comprising:

a sectional handle including an upper elongate section having both a top end and a bottom end and a lower elongate section having both a top end and a bottom end and a substitutive section having a flexibility characteristic different from said upper elongate section and said lower elongate section and that can be substituted for either said upper elongate section or said lower elongate section;

a mechanism for interlocking said upper elongate section with said lower elongate section such that said upper elongate section is substantially axially aligned with said lower elongate section; and a head mounted on one end of said sectional handle and including both a closed-loop frame and a net suspended within the confines of said frame;

wherein at least one of said upper or lower elongate sections is modular and said interlocking mechanism is releasable so that at least one of said upper elongate section or said lower elongate section may be replaced as desired and wherein said elongate sections are interchangeable.

15. A lacrosse stick, according to claim 14, wherein the length of said upper elongate section is substantially equal to the length of said lower elongate section.

16. A lacrosse stick according to claim 14, wherein said upper elongate section and said lower elongate section each comprise substantially hollow tubing having a cross-section substantially resembling a shape selected from the group consisting of a circle, an ellipse, a polygon, and an octagon.

17. A lacrosse stick according to claim 16 wherein said upper elongate section comprises aluminum.

18. A lacrosse stick according to claim 16, wherein said upper elongate section comprises titanium.

19. A lacrosse stick according to claim 16, wherein said lower elongate section comprises at least one constituent material selected from the group consisting of aluminum, chromium, copper, fiberglass, graphite, iron, manganese, magnesium, plastic, silicon, titanium, and zinc.

20. A lacrosse stick according to claim 16, wherein said lower elongate section comprises aluminum and graphite.

21. A lacrosse stick according to claim 16, wherein said lower elongate section comprises aluminum substantially covered with woven graphite fibers.

22. A lacrosse stick according to claim 16, wherein said interlocking mechanism includes an axially aligned protrusion located on one of either said upper elongate section or said lower elongate section, and wherein said protrusion is suited for being matingly received and locked within a hollow of the other one of either said upper elongate section or said lower elongate section.

23. A lacrosse stick according to claim 14, said substitutive section includes at least one substitutive upper elongate section for said sectional handle;

wherein said at least one substitutive upper elongate section has a top end and a locking bottom end; and wherein said at least one substitutive upper elongate section has a unique flexibility characteristic and is selectively interchangeable, in a modular fashion, with said upper elongate section interlocked within said sectional handle.

24. A lacrosse stick according to claim 14, said substitutive section includes at least one substitutive lower section for said sectional handle;

wherein said at least one substitutive lower elongate section similarly has a locking top end and a bottom end; and wherein said at least one substitutive lower elongate section has a unique flexibility characteristic and is selectively interchangeable, in a modular fashion, with said lower elongate section interlocked within said sectional handle.

25. A lacrosse stick according to claim 14, said sectional handle further comprising an intermediate elongate section having a locking top end and a locking bottom end, wherein said mechanism interlocks said upper elongate section with said locking top end of said intermediate elongate section such that said upper elongate section is substantially axially aligned with said intermediate elongate section; and a second mechanism for interlocking said locking bottom end of said intermediate elongate section with said lower elongate section such that said intermediate elongate section is substantially axially aligned with said lower elongate section.

26. A lacrosse stick according to claim 25, said sectional handle further comprising at least one substitutive intermediate elongate section;

wherein said at least one substitutive intermediate elongate section similarly has a locking top end and a locking bottom end; and wherein said at least one substitutive intermediate elongate section has a unique flexibility characteristic and is selectively interchangeable, in a modular fashion, with said intermediate elongate section interlocked within said sectional handle.

27. A sectional handle for a lacrosse stick, said sectional handle comprising:

an upper elongate section;

an intermediate elongate section;

a lower elongate section;

a first interlocking mechanism for interlocking said upper elongate section with said intermediate elongate section such that said upper elongate section is substantially axially aligned with said intermediate elongate section;

a second interlocking mechanism for interlocking said intermediate elongate section with said lower elongate section such that said intermediate elongate section is substantially axially aligned with said lower elongate section;

wherein a top end of said upper elongate section is suited for having mounted thereon a head including both a closed-loop frame and a net suspended substantially within the confines of said frame; and wherein said upper, intermediate, and lower elongate sections are modular and said first and second interlocking mechanisms are releasable so that at least one of said upper elongate section, intermediate elongate section, and lower elongate section may be replaced as desired and wherein said upper elongate section and said lower elongate section are constructed of different materials such that they provide the handle section with different performance characteristics and wherein said elongate sections are interchangeable.

* * * * *

UNITED STATES PATENT AND TRADEMARK OFFICE

CERTIFICATE OF CORRECTION

PATENT NO. : 7,108,616 B2
APPLICATION NO. : 10/709696
DATED : September 19, 2006
INVENTOR(S) : Morrow et al.

It is certified that error appears in the above-identified patent and that said Letters Patent is hereby corrected as shown below:

Col. 7, Line 52, replace “ma tingly” with --matingly--

Signed and Sealed this

Nineteenth Day of June, 2007

JON W. DUDAS
*Director of the United States Patent and Trademark Office*